US009181712B2

(12) United States Patent
Laufer et al.

(10) Patent No.: US 9,181,712 B2
(45) Date of Patent: Nov. 10, 2015

(54) INTERLOCKING PANEL ASSEMBLY FOR MODULAR BUILDING CONSTRUCTION

(71) Applicant: Custom Steel Manufacturing Ltd., Winnipeg (CA)

(72) Inventors: Lance C. Laufer, Winnipeg (CA); Domingo C. Palo, Winnipeg (CA)

(73) Assignee: Custom Steel Manufacturing, Ltd., Winnipeg, Manitoba (CA)

( * ) Notice: Subject to any disclaimer, the term of this patent is extended or adjusted under 35 U.S.C. 154(b) by 0 days.

(21) Appl. No.: 14/493,962

(22) Filed: Sep. 23, 2014

(65) Prior Publication Data

US 2015/0082727 A1 Mar. 26, 2015

Related U.S. Application Data

(60) Provisional application No. 61/881,236, filed on Sep. 23, 2013.

(51) Int. Cl.

| | |
|---|---|
| ***E04B 9/00*** | (2006.01) |
| ***E06B 3/54*** | (2006.01) |
| ***E04F 13/08*** | (2006.01) |
| ***E04B 2/02*** | (2006.01) |
| ***E04C 2/38*** | (2006.01) |

(52) U.S. Cl.

CPC ..... *E04F 13/0894* (2013.01); *E04B 2/02* (2013.01); *E04C 2/38* (2013.01); *E04F 13/0876* (2013.01); *E04B 2002/0232* (2013.01); *E04B 2002/0243* (2013.01)

(58) Field of Classification Search

CPC .... E04F 13/0894; E04F 13/0876; E04B 2/02; E04B 2002/0232; E04B 2002/0243; E04C 2/38; E04C 2/292; E04C 2/288

USPC ..... 52/309.9, 309.14, 478, 483.1, 520, 525, 52/539, 543

See application file for complete search history.

(56) References Cited

U.S. PATENT DOCUMENTS

| | | | | |
|---|---|---|---|---|
| 4,104,840 | A * | 8/1978 | Heintz et al. | 52/309.9 |
| 4,267,679 | A * | 5/1981 | Thompson | 52/588.1 |
| 4,271,652 | A * | 6/1981 | Svensson | 52/478 |
| 4,671,038 | A * | 6/1987 | Porter | 52/586.1 |
| 5,870,867 | A * | 2/1999 | Mitchell | 52/220.1 |
| 5,927,032 | A * | 7/1999 | Record | 52/309.11 |
| 6,857,243 | B2 * | 2/2005 | Bloomfield | 52/591.4 |
| 8,191,328 | B1 * | 6/2012 | Liu | 52/588.1 |

* cited by examiner

*Primary Examiner* — Brian D Mattei

(74) *Attorney, Agent, or Firm* — Ryan W. Dupuis; Kyle R. Soutterthwaite; Ade & Company Inc.

(57) ABSTRACT

A modular building panel assembly which is assembled with other similar panels to form a building structure includes spaced apart inner and outer wall portions joined to one another at opposing first and second end portions. The first end portion includes a first flange portion defining a male connector. The second end portion includes a second flange portion which partially defines a female connector together with the inner wall portion so as to receive the male connector of an adjacent assembly therein. The inner wall portion overlaps the second flange portion of the second end portion in the lateral direction so as to be arranged to receive a common fastener penetrated collectively through the inner wall portion, the second flange portion, and the first flange portion of said adjacent assembly in the assembly building structure.

14 Claims, 5 Drawing Sheets

INTERLOCKING PANEL ASSEMBLY FOR MODULAR BUILDING CONSTRUCTION

This application claims the benefit under 35 U.S.C. 119(e) of U.S. provisional application Ser. No. 61/881,236, filed Sep. 23, 2013.

FIELD OF THE INVENTION

The present invention relates to the construction of light building structures using a modular interlocking panel design.

BACKGROUND

It has been known that many building structures are assembled with combinations of modular panel, floor and roof panels. These structures can be delivered as completed assemblies; as panel sets; or as a combination of sub assemblies and panel sets which are assembled onsite. There is often a need for these structures to be of a double wall design, inner and outer wall faces separated by a space that is filled or void, typically for the purpose of the installation of insulation, or for the ability to attach items on one or the other of the inner or outer walls without penetrating the other wall.

It is common for these double wall structures to be constructed as single wall structures with the second wall added either internally or externally. The single wall systems are typically joined together with interlock or butt type joints.

It is also common for these structures to be assembled from pre manufactured double wall panel sections which are more commonly connected using a panel interlock system, which may or may not include a separate joining component.

These connection methods tend to have several things in common: 1) They have one or more interlocking male and female connector elements; 2) They have male connector elements on one side and female elements on the other if the panels connect directly to each other; or they have the same male or female connectors on both sides of the panel and the separate connector section has the opposite connector on both sides. Thus it can be seen that each panel can be joined with a like adjacent second panel.

The primary disadvantage of the prior art panels is that the sealing between the panels as well as the structural transfer between the panels as the connecting elements tend to have to be made structurally light enough to allow penetration and fitment tolerant enough to allow for tolerances in manufacturing and assembly.

SUMMARY OF THE INVENTION

An object of the present invention is to provide a double walled modular building panel and an interlock mechanism thereof so as to overcome the above disadvantages.

The objects of the invention are achieved by creating a female connection element between the inner wall and the side walls, which may be or not be part of the outer wall, that receives the male connection element from an adjacent panel. A fastener then passes through the inner wall of the first panel, the male element of the outer wall of the second panel and finally through the sidewall element of the first panel, tightly fastening all three components together.

Further the panel is designed so that the inner wall is supported by the male element on one side and by the female element on the other.

According to one aspect of the invention there is provided a building panel assembly for connection to an adjacent assembly of like configuration in construction of an assembled building structure, the panel assembly comprising:

an outer wall portion spanning an outer side of the panel assembly in a vertical direction between opposing top and bottom ends of the panel assembly and in a lateral direction between opposing first and second ends of the panel assembly;

an inner wall portion spanning an inner side of the panel assembly at a location spaced inwardly from the outer wall portion so as to define a cavity therebetween;

a first end portion joined between the outer wall portion and the inner wall portion at the first end of the panel assembly; and a second end portion joined between the outer wall portion and the inner wall portion at the second end of the panel assembly;

the first end portion including a first flange portion which protrudes outwardly in the lateral direction beyond the inner wall panel at the first end of the panel assembly to define a male connector;

the second end portion including a second flange portion which at least partially defines a female connector which is recessed inwardly in the lateral direction relative to the inner wall panel at the second end of the panel assembly so as to be arranged to receive the male connector of said adjacent assembly therein in an assembled configuration;

wherein the inner wall portion overlaps the second flange portion of the second end portion in the lateral direction so as to be arranged to receive a common fastener penetrated collectively through the inner wall portion, the second flange portion, and the first flange portion of said adjacent assembly in the assembly building structure.

According to a second aspect of the present invention there is provided a building structure comprising:

a plurality of wall panel assemblies wherein at least some of the wall panel assemblies each comprise a modular panel assembly being connected to an adjacent one of the modular panel assemblies, each modular panel assembly comprising:

an outer wall portion spanning an outer side of the panel assembly in a vertical direction between opposing top and bottom ends of the panel assembly and in a lateral direction between opposing first and second ends of the panel assembly;

an inner wall portion spanning an inner side of the panel assembly at a location spaced inwardly from the outer wall portion so as to define a cavity therebetween;

a first end portion joined between the outer wall portion and the inner wall portion at the first end of the panel assembly; and a second end portion joined between the outer wall portion and the inner wall portion at the second end of the panel assembly;

the first end portion including a first flange portion which protrudes outwardly in the lateral direction beyond the inner wall panel at the first end of the panel assembly to define a male connector;

the second end portion including a second flange portion which at least partially defines a female connector which is recessed inwardly in the lateral direction relative to the inner wall panel at the second end of the panel assembly so as to be arranged to receive the male connector of said adjacent assembly therein in an assembled configuration; and a plurality of joining fasteners joining the panel assemblies to one another, each joining fastener being collectively penetrated through:

the inner wall portion and the second flange portion of a first one of the panel assemblies; and the first flange portion of a second one of the panel assemblies which is adjacent to said first one of the panel assemblies.

According to a third aspect of the present invention there is provided a method of building a structure comprising:

providing a plurality of modular wall panel assemblies comprising:

an outer wall portion spanning an outer side of the panel assembly in a vertical direction between opposing top and bottom ends of the panel assembly and in a lateral direction between opposing first and second ends of the panel assembly;

an inner wall portion spanning an inner side of the panel assembly at a location spaced inwardly from the outer wall portion so as to define a cavity therebetween;

a first end portion joined between the outer wall portion and the inner wall portion at the first end of the panel assembly; and a second end portion joined between the outer wall portion and the inner wall portion at the second end of the panel assembly;

the first end portion including a first flange portion which protrudes outwardly in the lateral direction beyond the inner wall panel at the first end of the panel assembly to define a male connector;

the second end portion including a second flange portion which at least partially defines a female connector which is recessed inwardly in the lateral direction relative to the inner wall panel at the second end of the panel assembly so as to be arranged to receive the male connector of said adjacent assembly therein in an assembled configuration; and joining a first one and a second one of the panel assemblies by:

inserting the first flange portion defining the male connector of the first one of the panel assemblies into the female connector of the second one of the panel assemblies; and inserting fasteners collectively through the inner wall portion of the second one of the panel assemblies, the second flange portion of the second one of the panel assemblies, and the first flange portion of the first one of the panel assemblies.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 7:
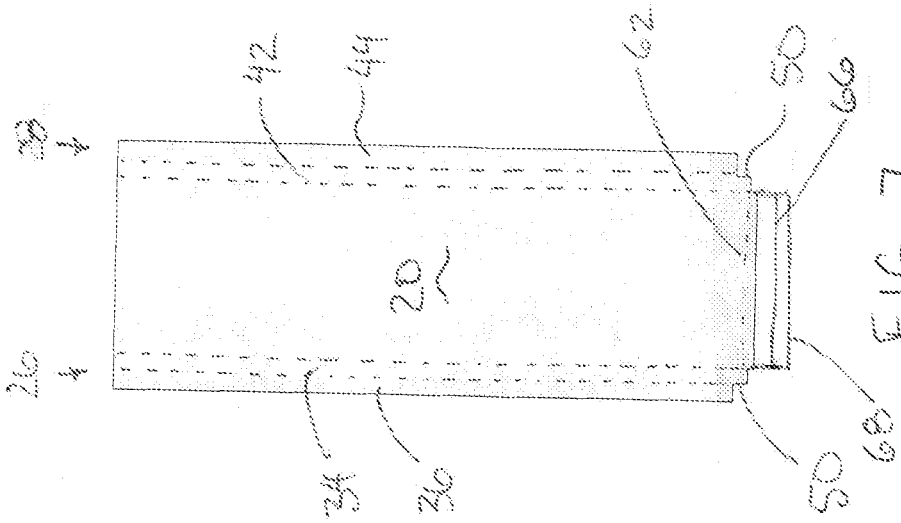
FIG. 7 is a plan view of a sheet metal blank for forming the outer portion of the building panel assembly.
Figure 2:
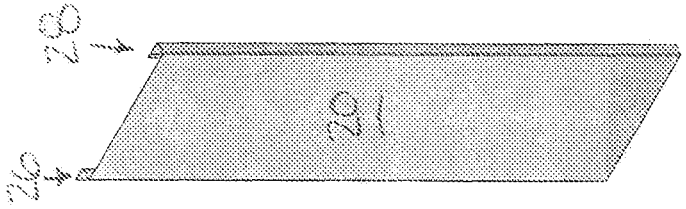
FIG. 2 is a perspective view of an outer side of the outer portion of the building panel assembly.
Figure 1:
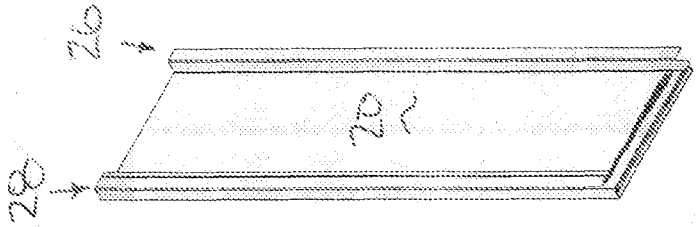
FIG. 1 is a perspective view of an inner side of an outer portion of a building panel assembly.
Figure 4:
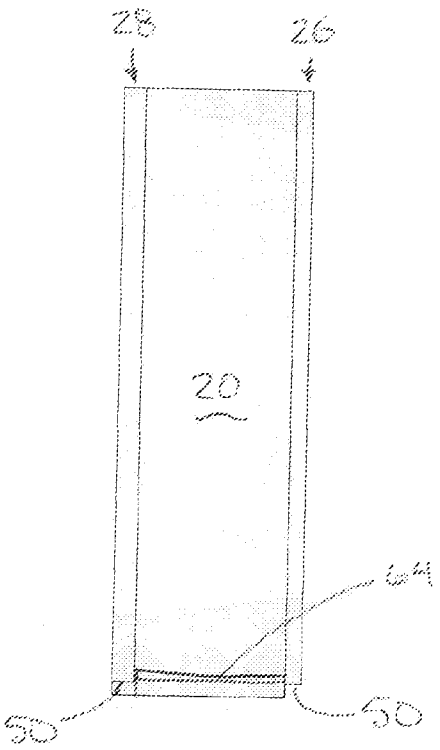
FIG. 4 is an inner elevational view of the outer portion of the building panel assembly.
Figure 5:
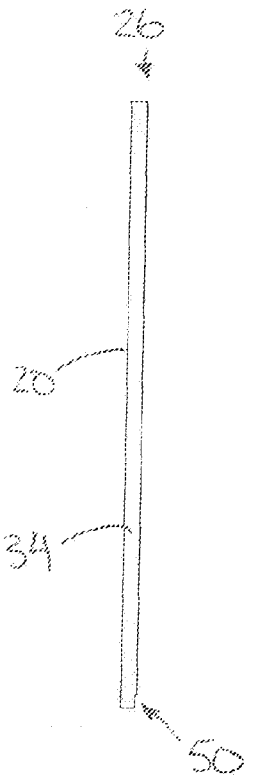
FIG. 5 is an end elevational view of the outer portion of the building panel assembly.
Figure 3:
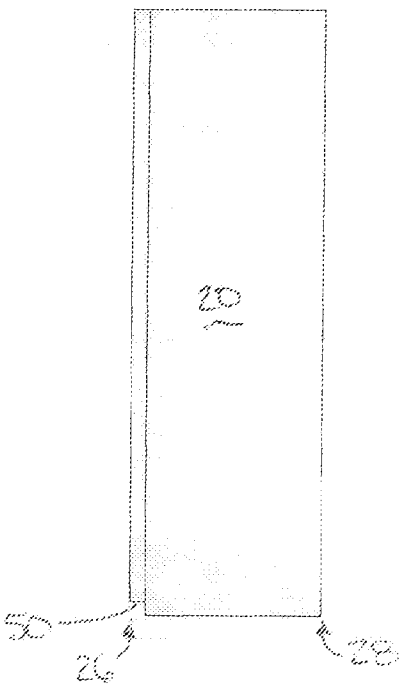
FIG. 3 is an outer elevational view of the outer portion of the building panel assembly.
Figure 6:
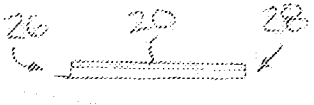
FIG. 6 is a bottom view of the outer portion of the building panel assembly.
Figure 8:
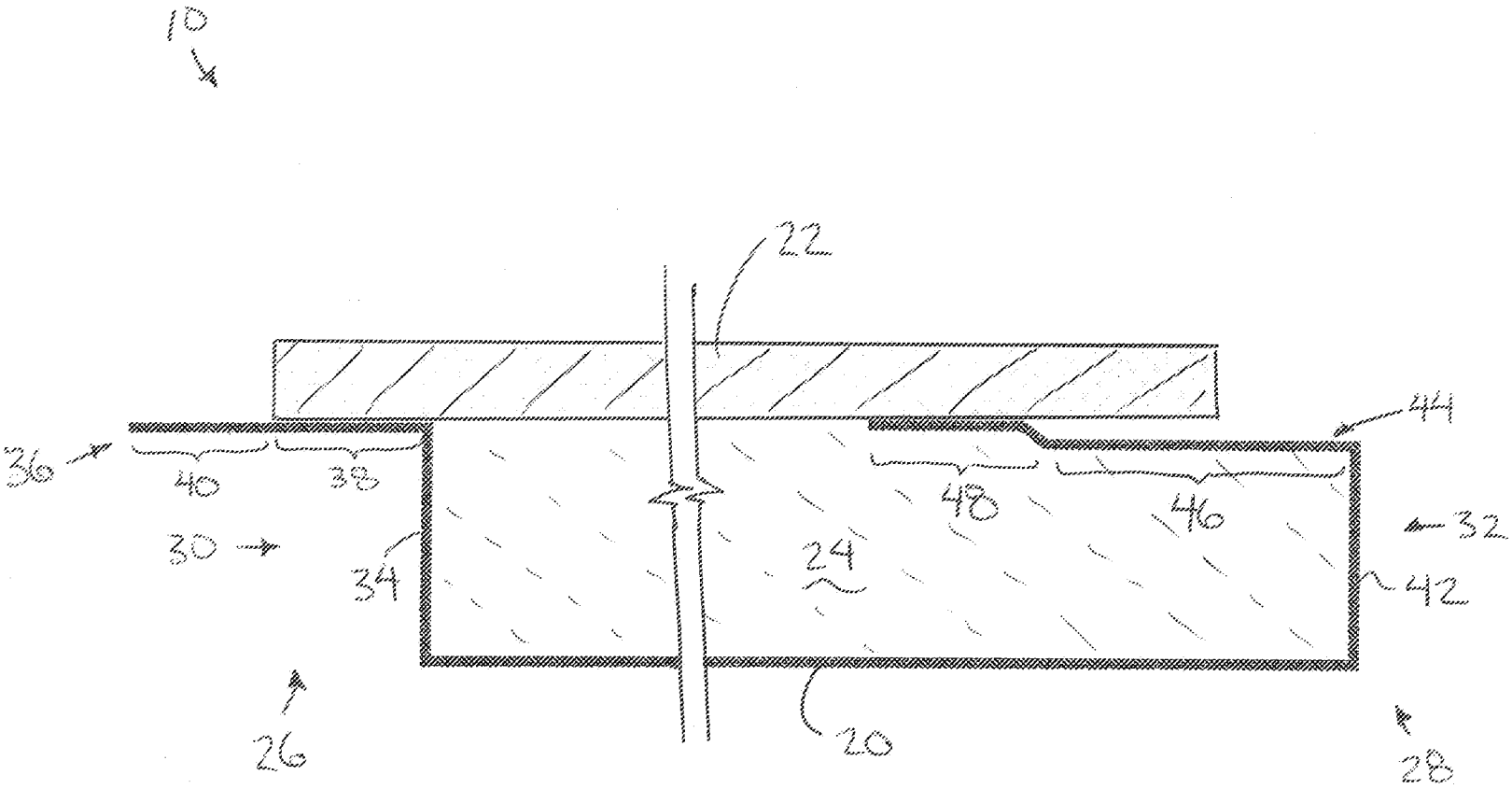
FIG. 8 is a schematic top plan view of the building panel assembly.
Figure 9:
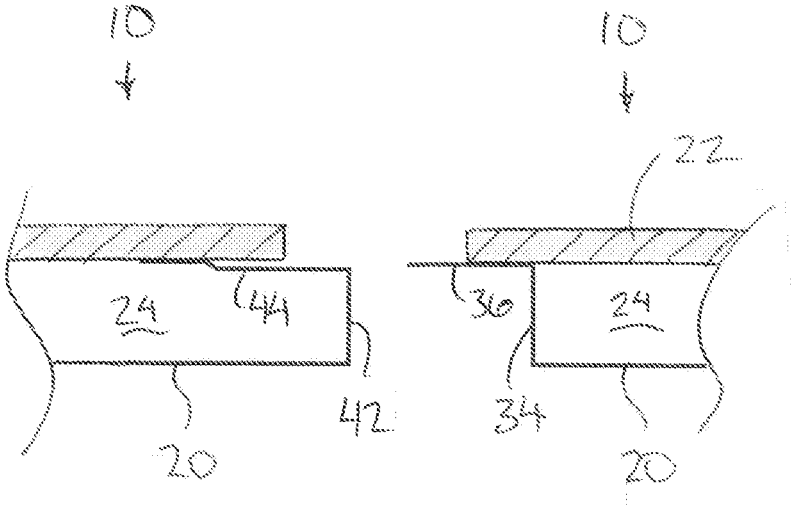
FIG. 9 is a schematic top plan view of two building panel assemblies to be connected.
Figure 10:
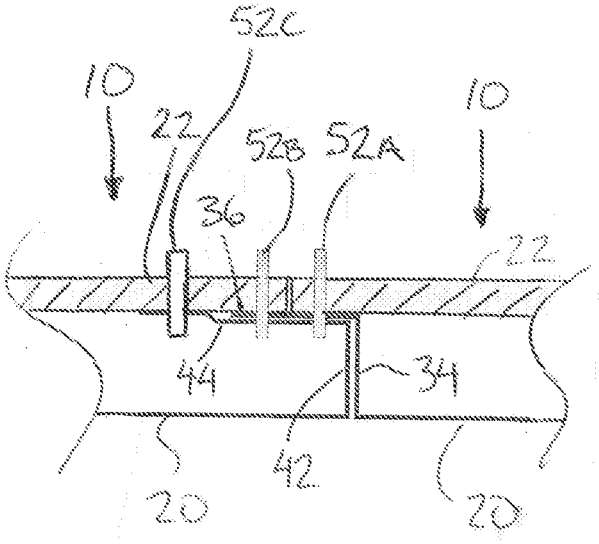
FIG. 10 is a top plan view of the connection between the two building panel assemblies.
Figure 11:
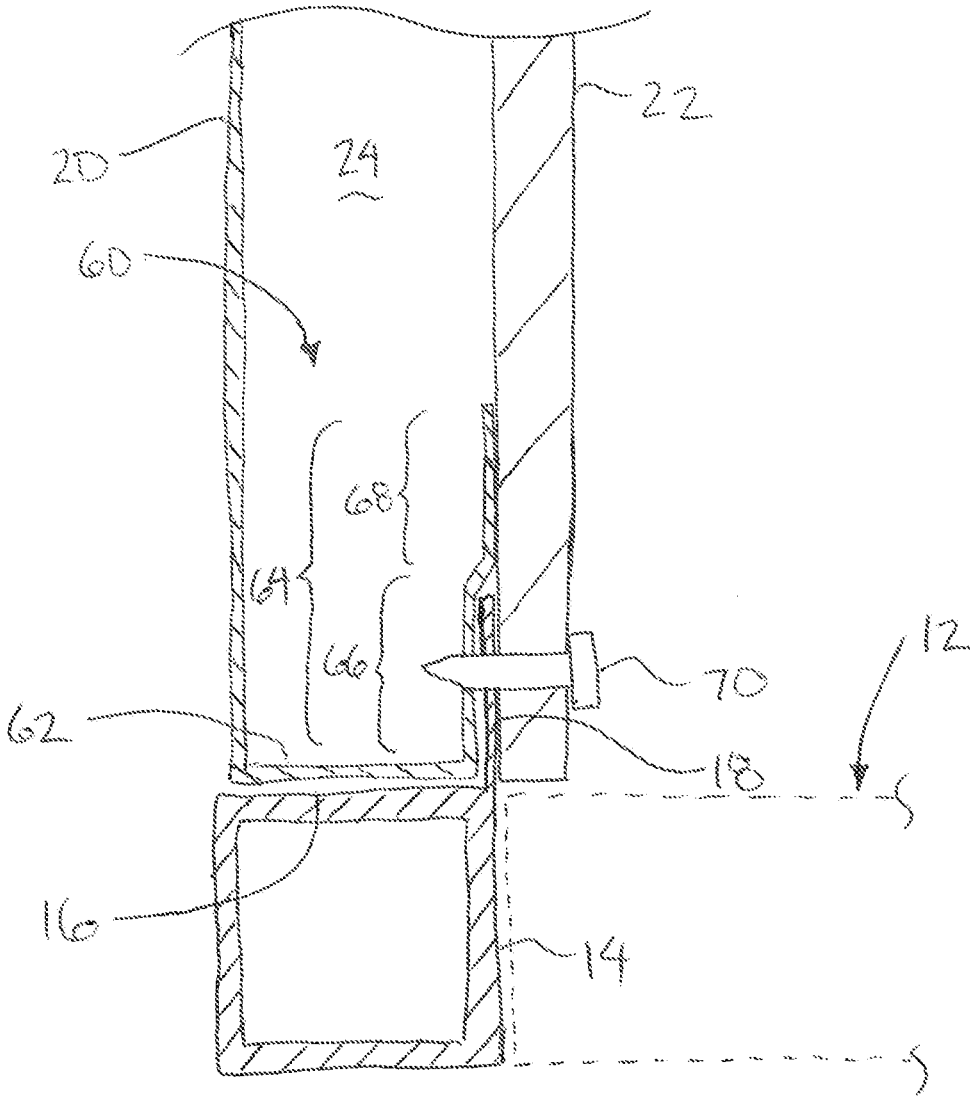
FIG. 11 is a schematic end view of one building panel assembly supported on the perimeter base member.

Referring to the accompanying figures, there is illustrated a modular building panel assembly generally indicated by reference numeral 10. The assembly 10 is particularly suited for use in light building structures. Typically, a plurality of the panel assemblies are delivered as separate preassembled modules for interlocking connection with one another at a building site. Each assembled modular panel assembly 10 defines a portion of the resulting exterior surface of the building, a portion of the interior surface of the resulting building structure, and a core cavity therebetween which can receive a layer of insulation there or remain void.

In preferred instances, the panels are readily joined to form the building structure at a common factory location where the panel assemblies are manufactured. The panel assemblies are also well suited for transport to a remote site prior to assembly into the building structure, such that the panels can be joined at the site of the building if desired due to the use of interlocking connections and joining fasteners which simplify the building process as described in further detail below.

The construction of the building begins by initially providing a perimeter base member 14 forming the base of the wall structures about the perimeter of the building to be assembly. The perimeter base member 14 typically comprises a tubular metal beam having a horizontal upper surface 16 upon which the bottom ends of the panel assemblies 10 are abutted in a mounted configuration. When a floor system 12 is provided, the floor system is typically anchored about its perimeter to the perimeter base member 14.

The perimeter base member 14 further includes an inner flange 18 which extends vertically upward from an inner side of the tubular beam portion so as to be formed integrally and seamlessly therewith. The inner flange is located at the inner side of the panel assemblies supported on the base member as described in further detail below.

Each panel assembly 10 generally includes an outer wall portion 20 at the outer side and an inner wall portion 22 at the inner side which are supported spaced apart from one another to define a cavity 24 therebetween which is suitable for receiving a core insulation therein if desired. Each of the outer wall portion and inner wall portion generally span vertically substantially the full height between the top and bottom ends of the panel assembly and span in a lateral direction substantially a full width between a first end 26 and a second end 28 of the panel assembly.

The inner and outer wall portions are supported spaced apart at the opposing first and second ends by a first end portion 30 and a second end portion 32 respectively. Each of the first and second end portions is formed integrally with the outer wall panel such that the first end portion 30, the outer wall portion 20 and the second end portion 32 comprise a continuous, seamless and integral sheet of metal cut into a suitable pattern as shown in FIG. 7 and subsequently folded into the corresponding shape shown in FIGS. 1 through 6.

The inner wall portion 22 comprises a rigid panel, for example a sheet of plywood or a metal sheet of aluminum or the like, which spans parallel to the outer wall portion to be joined at opposing first and second ends to the corresponding ones of the first and second end portions of the panel assembly, as described in further detail below.

The first end portion 30 includes a first end wall 34 which is oriented perpendicularly to the outer wall portion and the lateral direction so as to extend substantially the full thickness of the panel assembly from the outer wall portion 20 at the outer side to an inner surface of the inner wall portion 22 at the inner side. The first end wall 34 also spans the full height of the panel assembly.

The first end portion 30 also includes a first flange portion 36 consisting of a singular, planar flange member which also extends along substantially the full height of the panel assembly, but which is oriented in the lateral direction to extend outwardly from the first end wall 34 at the inner side of the panel. The first flange portion includes an inner portion 38 closest to the first end wall which is overlapped by the first end of the inner wall panel 22.

The first end of the inner wall portion 22 may be joined directly to the inner portion 38 of the first flange portion 36 which is abutted against the inner surface thereof. The first flange portion and the first end of the inner wall portion may be joined by temporary or permanent means at a manufacturing location of the panel assemblies prior to connection to adjacent panel assemblies, for example using adhesive or non-protruding fasteners. Alternatively, the first end of the inner wall panel may be joined to the first flange portion when panel assemblies are joined to one another in the assembly of the building structure using fasteners extending therethrough as described in further detail below.

The first flange portion 36 of each panel assembly also includes a remaining outer portion 40 adjacent to the inner portion at a location spaced outwardly from the first end wall. The outer portion 40 projects in the lateral direction beyond the first end of the inner wall portion to a free end, and defines a male connector of the panel assembly at the first end thereof.

The second end portion 32 of each panel assembly similarly includes a second end wall 42 which is perpendicular to the outer wall portion and the lateral direction. The second end wall spans the full height of the panel assembly and nearly the full thickness from the outer wall portion towards the inner wall portion while maintaining a small gap from the inner wall portion to define a female connector at the second end of the panel assembly as described in more detail below.

The second end portion 32 also includes a second flange portion 44 which extends in the lateral direction from the second end wall inwardly towards the opposing first end of the panel along nearly a full height of the panel. The second flange portion 44 includes an outer portion 46 having a dimension in the lateral direction corresponding to the lateral dimension of the first flange portion. The outer portion 46 of the second flange portion is immediately adjacent the second end wall 42 such that when two panel assemblies 10 are abutted with the first and second end walls thereof abutted with one another, the first flange portion 36 of one panel assembly 10 overlaps the outer portion 46 of the second flange portion 44 of an adjacent panel assembly 10 along the full height and width thereof.

The outer portion 46 of the second flange portion 44 consists of a planar flange member which is spaced from the inner surface of the inner wall portion by the noted gap which corresponds in thickness to the thickness of the first flange portion 36. Accordingly, a female connector is defined at the second end of each panel assembly between the outer portion 46 of the second flange portion 44 and the inner surface of the inner wall portion 22 which receives the portion of the first flange portion 36 which defines the male connector of an adjacent panel therein.

The second end of the inner wall portion is recessed in the lateral direction relative to the second end wall by the same distance that the first end of the panel assembly protrudes beyond the first end wall in the lateral direction such that when the first and second end walls of adjacent panel assemblies are abutted the corresponding first and second ends of the inner wall portions 22 are also abutted.

Each second flange portion 44 also includes an inner portion 48 joined along the edge of the outer portion 46 opposite from the second end wall so as to be nearer to the opposing first end of the panel than the outer portion. The inner portion 48 is offset from the outer portion 46 towards the inner surface of the inner wall portion 22 such that the inner portion 48 of the second flange portion 44 and the inner surface of the inner wall portion are directly abutted and joined with one another.

The inner portion 48 and the inner wall portion 22 can be joined with one another using various means including temporary or permanent joining techniques, for example adhesive or fasteners, at a manufacturing location of the panel assemblies, prior to assembly into the finished building structure. When adjacent panel assemblies are subsequently joined together to form the building structure, additional fasteners can be penetrated through the various first and second flange portions and the inner wall portions 22 for securing the inner wall portions 22 to both the flange portions of the respective panel assembly and the flange portions of the adjacent panel assemblies as further described below.

At the bottom ends of the panel assemblies, the first and second flange portions which are located adjacent the inner side may each be provided with a cutaway portion 50 which is cut upwardly into the flange portion from the bottom end by a height corresponding approximately to the height of the inner flange 18 of the perimeter base member 14 to matingly receive the inner flange of the base therein when the bottom end of the panel assembly is abutted on the upper surface of the perimeter base member. The inner flange 18 is thus arranged to be flush at the inner surface thereof with the inner portions of the first and second flange portions respectively such that the inner portions of both first and second flange portions and the inner flange 18 of the perimeter base member all commonly abut the inner surface of the wooden sheet defining the inner wall portion 22. The inner wall portion extends downwardly overtop of the inner flange 18 of the wall portion to permit suitable joining fasteners to be penetrated commonly through the inner wall portion 22 adjacent the bottom side thereof and the inner flange 18 of the perimeter base member 14 in a mounted position.

In preferred embodiments, the bottom end of the panel is also provided with a bottom portion 60 which is joined between the outer wall portion and the inner wall portion at the bottom end of the panel assembly. The bottom portion 60 is formed integrally as a common sheet with the outer wall portion and is substantially identical in configuration to the second end portion 32 so as to define a female connector. The female connector receives the inner flange 18 of the perimeter base member therein so that the inner flange 18 acts as the corresponding male connector.

The bottom portion 60 includes a bottom wall 62 which is perpendicular to the inner and outer wall portions so as to substantially span the bottom end of the panel assembly and enclose the bottom end of the cavity 24.

The bottom portion 60 also includes a bottom flange portion 64 which extends upwardly from the inner edge of the bottom wall 62 adjacent the inner side of the panel. Similar to the second flange portion 44, the bottom flange portion 64 including an outer portion 66 which is parallel to the inner wall portion but which remains spaced from the inner wall portion by the thickness of the inner flange 18. An inner portion 68 of the bottom flange portion 64 is connected to the outer portion along substantially the full lateral width of the panel assembly. The inner portion 68 is offset towards the inner wall portion relative to the outer portion 66 so as to be substantially flush at the outer side thereof with the inner portion 48 of the second flange portion 44 and the inner flange 18 of the perimeter base member. The inner portion 68 is thus suited for direct abutment against the inner surface of the inner wall portion 22 to permit joining therebetween by suitable fastening. The inner portion 68 and inner wall portion 22 can be joined directly at the manufacturing location for the panel.

With the outer portion 66 being offset from the inner wall portion 22 by the thickness of the inner flange, the outer portion 66 and the inner surface of the inner wall portion 22 define parallel and opposed sides of the bottom female connector of the panel assembly that receives the male connector inner flange 18 therein.

In use, each panel assembly is initially assembled at a manufacturing location to define the inner wall portion 22, the outer wall portion 20 and the first and second end portions with a cavity suitable for insulation therebetween as a single assembled unit. The sheet member defining the inner wall portion 22 is joined to the inner portion 38, 48, or 68 of any one or all of the first, second and bottom flange portions 36, 44, and 64 at the manufacturing location, for example either using temporary or permanent fastening techniques such as adhesive, welding, or fasteners of various forms.

The units are then assembled into the building structure either at the manufacturing location or another remote site. The perimeter base member 14 is initially assembled to form the perimeter of the building in a manner which is suitable for being placed on the building foundation. The panel assemblies are sequentially mounted onto the perimeter base member with the inner flange 18 of the perimeter base member being inserted up into a corresponding female connector defined between the inner wall portion 22 and the outer portion 66 of the bottom flange portion 60. Fasteners 70 can then be collectively penetrated through the inner wall portion, the inner flange of the perimeter base member and the bottom flange portion at the bottom of the respective panel assembly for joining the panel assemblies to the perimeter base member.

As each panel assembly is positioned next to a previously installed panel assembly, the adjacent panel assemblies are interlocked by inserting the male connector of one panel assembly into the female connector of the other panel assembly until the corresponding first and second end walls of the panel assemblies are abutted at which point the corresponding first and second ends of the inner wall portions are also abutted. The panels are then joined using joining fasteners 52 which are penetrated into the panel assemblies from the inner side by initially penetrating the fasteners through the inner wall portion 22 and subsequently through corresponding first and second flange portions of the panel assemblies.

Typically, a first set of joining fasteners 52A are inserted through the inner wall portions 22 at the first ends thereof such that each fastener is collectively penetrated through the inner wall portion of a first panel assembly, the inner portion of the first flange portion of the first panel assembly, and finally the outer portion of the second flange assembly of an adjacent panel assembly. The fasteners 52A thus provide the dual purpose of both securing the inner wall portion 22 to the outer wall portion 20 of the corresponding panel assembly as well as securing the interlocking connection between adjacent panel assemblies.

Two second sets of joining fasteners 52B and 52C can then each be used to secure the second end of the inner wall portion 22 relative to the outer wall portion 20. In the instance of fasteners 52B, the fasteners are collectively penetrated through the inner wall portion 22 adjacent the second end of the first panel assembly, followed by penetration through the outer portion 40 of the first flange portion of another adjacent panel assembly, and finally through the outer portion 46 of the second flange portion of the first panel assembly again. The fasteners 52B thus also provide the dual purpose of both securing the inner wall portion 22 to the outer wall portion 20 of the corresponding panel assembly as well as securing the interlocking connection between adjacent panel assemblies.

In the instance of fasteners 52C, the fasteners are penetrated through the inner wall portion 22 of the first panel assembly, followed by penetration through the inner portion 48 of the second flange portion 44 such that the fasteners 52C do not contribute to securing of adjacent panels to one another.

In typical arrangements only one of the second sets of fasteners, either 52B or 52C is used, as the fasteners 52A are sufficient by themselves to maintain a secure connection between adjacent panels. The fasteners 52B have the advantage of making the connection between adjacent panels more secure, while the fasteners 52C have the advantage of being able to be fastened in place at the manufacturing location before adjacent panels are interconnected to form the building structure. In this manner the first end portion, the second end portion and the outer wall portion defining a respective portion of a resulting exterior surface of the building structure, of each panel assembly are formed of a continuous, seamless, integral, folded sheet of metal extending between first and second ends of the folded sheet at the opposing first and second ends of the modular panel assembly. Furthermore the inner wall portion defining a respective portion of a resulting interior surface of the building structure consists of a single sheet of material spanning between first and second ends of the single sheet joined to the first and second ends of the folded sheet at the opposing first and second ends of the modular panel assembly.

In a typical installation, a suitable sealant is provided along one or both of the end walls of the panel assemblies for sealing engagement with corresponding end walls of an abutted panel assembly. The sealant can be applied in strip form at the manufacturing location, or can be applied to the end walls at the time of assembly of the building structure, for example in the form of an uncured caulking which cures after joining the panel assemblies to one another.

The remainder of the building is constructed by providing a door opening in the perimeter of panel assemblies forming the walls of the building structure within which a door is subsequently mounted. Additionally, corner panels may be provided in which the outer wall portion includes a first section adjacent the first end and a second section adjacent the second end which is bent relative to the first section at a right angle or other suitable angle corresponding to the corner of the building. The first and second end portions in this instance remain substantially identical for connection to the corresponding first and second end portions of adjacent panel assemblies.

Finally, a suitable roof structure is mounted to span across the top end of the building structure between the top ends of the joined panel assemblies forming the perimeter wall of the building.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A building panel assembly in combination with an adjacent panel assembly of like configuration for use in construction of an assembled building structure, each panel assembly comprising:

an outer wall portion spanning an outer side of the panel assembly in a vertical direction between opposing top and bottom ends of the panel assembly and in a lateral direction between opposing first and second ends of the panel assembly;

an inner wall portion spanning an inner side of the panel assembly at a location spaced inwardly from the outer wall portion so as to define a cavity therebetween;

a first end portion joined between the outer wall portion and the inner wall portion at the first end of the panel assembly; and a second end portion joined between the outer wall portion and the inner wall portion at the second end of the panel assembly such that the inner wall portion is recessed inwardly in the lateral direction relative to the second end of the panel assembly;

the first end portion including a first flange portion consisting of a planar flange member which protrudes outwardly in the lateral direction beyond the inner wall portion and the outer wall portion at the first end of the panel assembly to define a male connector;

the second end portion including a second flange portion comprising an inner flange arranged to be joined to the inner wall portion and an outer flange which extends laterally outward from the inner flange, the outer flange of the second flange portion consisting of a planar flange member which forms at least one boundary of a groove defining a female connector which is recessed inwardly in the lateral direction relative to a portion of the second end portion and relative to the inner wall portion at the second end of the panel assembly so as to be arranged to receive the male connector of another panel assembly therein in an assembled configuration;

wherein the inner wall portion of the building panel assembly overlaps only a portion of the outer flange of the second flange portion of the second end portion in the lateral direction;

wherein the male connector of the adjacent panel assembly is inserted into the female connector of the building panel assembly; and wherein a common fastener is penetrated collectively through the inner wall portion of the adjacent panel assembly adjacent the first end of the adjacent panel assembly, the first flange portion of the adjacent panel assembly adjacent the first end of the adjacent panel assembly, and the outer flange of the second flange portion of the building panel assembly.

2. The building panel assembly according to claim 1 wherein the first and second flange portions of each panel assembly are adjacent to the inner wall portion thereof.

3. The building panel assembly according to claim 1 wherein the female connector of each panel assembly is defined as a gap between the second flange portion and an inner surface of the inner wall portion of the panel assembly.

4. The building panel assembly according to claim 1 wherein the first end portion and the first flange portion thereof of each panel assembly are formed integrally with the outer wall portion of the panel assembly.

5. The building panel assembly according to claim 1 wherein the second end portion and the second flange portion thereof of each panel assembly are formed integrally with the outer wall portion of the panel assembly.

6. The building panel assembly according to claim 1 wherein the first end portion, the second end portion and the outer wall portion of each panel assembly are formed of a common sheet of metal.

7. The building panel assembly according to claim 1 wherein the inner wall portion of each panel assembly comprises a sheet of wood.

8. The building panel assembly according to claim 1 wherein an inner portion of the first flange portion of each panel assembly is overlapped by the inner wall portion and a remaining portion of the first flange portion of the panel assembly defines the male connector.

9. The building panel assembly according to claim 1 wherein the inner wall portion of each panel assembly is joined directly to the inner portion of the first flange portion of the panel assembly.

10. The building panel assembly according to claim 1 wherein the second flange portion of each panel assembly includes an outer portion which partly defines the female connector and an inner portion of the panel assembly which is inward in the lateral direction relative to said outer portion, the inner portion of the second flange portion being joined directly to the inner wall portion of the panel assembly.

11. The building panel assembly according to claim 1 in combination with a perimeter base member comprising an upper surface upon which the bottom end of each panel assembly is supported and an inner flange extending upwardly from an inner side of the upper surface at the inner side of the panel assembly, the first and second end portions including a cutaway portion adjacent the bottom end of the panel assembly which receives the inner flange of the perimeter base member matingly therein.

12. The building panel assembly according to claim 1 in combination with a perimeter base member comprising an upper surface upon which the bottom end of each panel assembly is supported and an inner flange extending upwardly from an inner side of the upper surface at the inner side of each panel assembly, each panel assembly further comprising:

a bottom portion joined between the outer wall portion and the inner wall portion at the bottom end of the panel assembly;

the bottom portion including a bottom flange portion which at least partially defines a female connector receiving the inner flange of the perimeter base member; and a plurality of fasteners collectively penetrated through the inner wall portion, the inner flange of the perimeter base member and the bottom flange portion at the bottom of the respective panel assembly.

13. A building structure comprising:

a plurality of wall panel assemblies wherein at least some of the wall panel assemblies each comprise a modular panel assembly being connected to an adjacent one of the modular panel assemblies, each modular panel assembly comprising:

an outer wall portion defining a respective portion of a resulting exterior surface of the building structure, the outer wall portion spanning an outer side of the modular panel assembly in a vertical direction between opposing top and bottom ends of the modular panel assembly and in a lateral direction between opposing first and second ends of the modular panel assembly;

an inner wall portion defining a respective portion of a resulting interior surface of the building structure, the inner wall portion spanning an inner side of the modular panel assembly at a location spaced inwardly from the outer wall portion so as to define a cavity therebetween;

a first end portion joined between the outer wall portion and the inner wall portion at the first end of the panel assembly; and a second end portion joined between the outer wall portion and the inner wall portion at the second end of the modular panel assembly such that the inner wall portion is recessed inwardly in the lateral direction relative to the second end of the modular panel assembly;

the first end portion including a first flange portion which protrudes outwardly in the lateral direction beyond the inner wall portion and the outer wall portion at the first end of the modular panel assembly to define a male connector;

the second end portion including a second flange portion which forms at least one boundary of a groove defining a female connector which is recessed inwardly in the lateral direction relative to the inner wall portion at the second end of the modular panel assembly so as to be arranged to receive the male connector of another panel assembly therein in an assembled configuration; and the inner wall portion overlapping only a portion of the second flange portion of the second end portion in the lateral direction; and a plurality of joining fasteners joining the panel assemblies to one another, each modular panel assembly including at least one joining fastener which is collectively penetrated through:

the inner wall portion adjacent the first end of the modular panel assembly and the first flange portion of the modular panel assembly; and the second flange portion of said adjacent one of the modular panel assemblies;

wherein the first end portion, the second end portion and the outer wall portion of each panel assembly are formed of a continuous, seamless, integral, folded sheet of metal extending between first and second ends of the folded sheet at the opposing first and second ends of the modular panel assembly; and wherein the inner wall portion consists of a single sheet of material spanning between first and second ends of the single sheet joined to the first and second ends of the folded sheet at the opposing first and second ends of the modular panel assembly.

14. A method of building a structure comprising:

providing a plurality of modular wall panel assemblies, each comprising:

an outer wall portion spanning an outer side of the panel assembly in a vertical direction between opposing top and bottom ends of the panel assembly and in a lateral direction between opposing first and second ends of the panel assembly;

an inner wall portion spanning an inner side of the panel assembly at a location spaced inwardly from the outer wall portion so as to define a cavity therebetween;

a first end portion joined between the outer wall portion and the inner wall portion at the first end of the panel assembly; and a second end portion joined between the outer wall portion and the inner wall portion at the second end of the panel assembly such that the inner wall portion is recessed inwardly in the lateral direction relative to the second end of the panel assembly;

the first end portion including a first flange portion consisting of a planar flange member which protrudes outwardly in the lateral direction beyond the inner wall portion and the outer wall portion at the first end of the panel assembly to define a male connector;

the second end portion including a second flange portion comprising an inner flange arranged to be joined to the inner wall portion and an outer flange which extends laterally outward from the inner flange, the outer flange of the second flange portion consisting of a planar flange member which forms at least one boundary of a groove defining a female connector which is recessed inwardly in the lateral direction relative to the inner wall portion at the second end of the panel assembly so as to be arranged to receive the male connector of an adjacent panel assembly therein in an assembled configuration; and joining a first one and a second one of the panel assemblies by:

inserting the first flange portion defining the male connector of the first one of the panel assemblies into the female connector of the second one of the panel assemblies; and inserting at least one fastener collectively through the inner wall portion of the first one of the panel assemblies, the first flange portion of the first one of the panel assemblies, and the outer flange of the second flange portion of the second one of the panel assemblies.

* * * * *